United States Patent [19]

Silvestri, Jr.

[11] Patent Number: 4,948,335

[45] Date of Patent: Aug. 14, 1990

[54] TURBINE MOISTURE REMOVAL SYSTEM

[75] Inventor: George J. Silvestri, Jr., Winter Park, Fla.

[73] Assignee: Westinghouse Electric Corp., Pittsburgh, Pa.

[21] Appl. No.: 292,275

[22] Filed: Dec. 30, 1988

[51] Int. Cl.[5] ..... F01D 25/32

[52] U.S. Cl. ..... 415/169.2; 415/169.1; 415/168.1

[58] Field of Search ..... 415/169.1, 169.2, 169.3, 415/169.4, 168.1, 168.2, 168.3; 60/685, 657, 646

[56] References Cited

U.S. PATENT DOCUMENTS

| | | | |
|---|---|---|---|
| 3,003,321 | 10/1961 | Warth | 415/168.2 |
| 3,058,720 | 10/1962 | Hart et al. | 415/169.4 |
| 3,104,964 | 9/1963 | Craft | 415/196.2 |
| 3,289,408 | 12/1966 | Silvestri | 415/169.2 |
| 3,675,423 | 7/1972 | Vidal et al. | 60/646 |
| 3,690,786 | 9/1972 | Silvestri | 415/169.4 |
| 3,706,510 | 12/1972 | O'Connor | 415/169.1 |
| 3,803,846 | 4/1974 | Letvin | 60/685 |
| 4,019,467 | 4/1977 | Binstock | 60/646 |

*Primary Examiner*—Robert E. Garrett
*Assistant Examiner*—Hoang Nguyen

[57] ABSTRACT

An apparatus and method for improving moisture extraction from a steam turbine incorporates a collection slot adjacent a last rotating stage of the turbine with the collection slot being vented outside the turbine by bores through the turbine wall. Moisture removal is enhanced by the use of pumps connected to each of the bores for suctioning water from the collection slot. The pumps may be ejectors powered by subcooled water to minimize flashing potential. The suctioned moisture is returned to the system after passing to a condenser.

8 Claims, 2 Drawing Sheets

FIG. 3
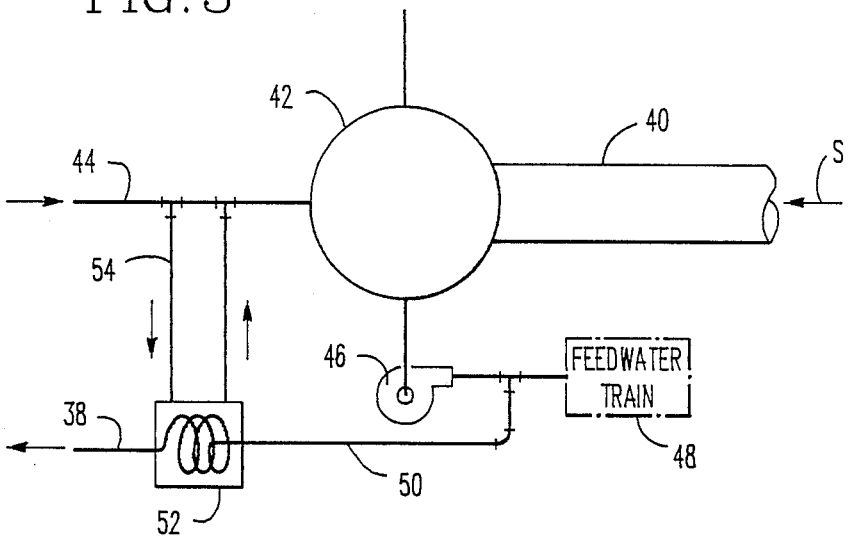
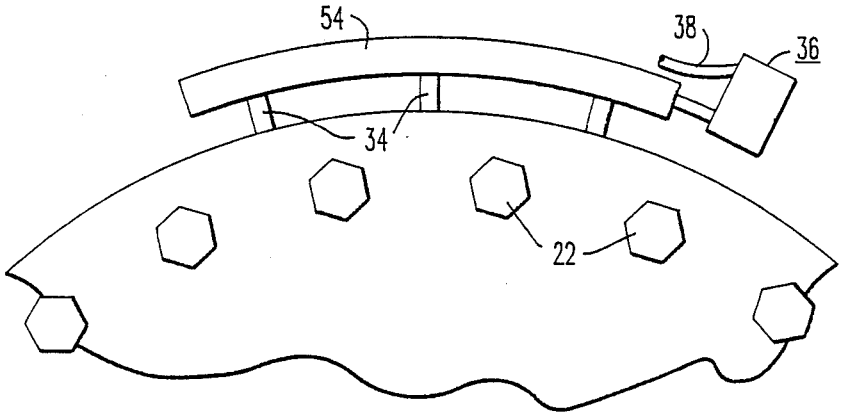
FIG. 4

TURBINE MOISTURE REMOVAL SYSTEM

BACKGROUND OF THE INVENTION

This invention relates to steam turbines, and more particularly, to an apparatus and method for improved moisture extraction from low pressure steam turbines operating at low load.

It is well-known that water droplets entrained in steam flow through a steam turbine system can cause serious erosion damage to system hardware. The erosion problem has been thoroughly discussed in a number of publications. For instance, U.S. Pat. No. 4,527,396 assigned to Westinghouse Electric Corporation discloses a moisture preseparator for removing erosion-causing entrained liquid from effluent traveling through a steam turbine exhaust system.

Accordingly, it has long been an object of steam turbine design to reduce erosion damage throughout the system by removing moisture content from the flow of live steam at a plurality of points along the route from turbine inlet to exhaust. One of these locations in at least one type of low pressure steam turbine is just upstream of the last rotating blade of the turbine, where an annular moisture extraction slot has been incorporated into the turbine casing. Moisture entering this extraction slot drains to a condenser. Steam entrained water droplets are propelled by the turbine blading to the casing where the droplets are suctioned to the condenser by virtue of a pressure differential.

Erosion damage studies performed on low pressure steam turbines at several power plant installations have resulted in data that indicate that at low loads such as, for example, less than about twenty percent, there is an insufficient pressure drop from the nozzle inlet of the last rotating blade tip to the condenser, to create sufficient suction to fully drain the water that collects in the annular collection slot. Since this water tends to dribble back into the blade path in the form of large droplets if it is not exhausted, the collected moisture may increase erosion of the last stage turbine blading. Additionally, condensation in the steam flow reduces the efficiency of the turbine.

At low loads, the water droplets tend to be larger and not entrained well by the steam. Larger droplets with their increased mass have been found to increase the erosion problem. A substantial portion of first-year erosion of turbines in nuclear installations is believed due to many hours of low-load operation, i.e., at loads below twenty percent, mandated by regulations applicable to nuclear reactor operations.

It is therefore an object of this invention to reduce low-load erosion damage in a steam turbine by improving moisture extraction adjacent a last rotating blade row in the turbine.

SUMMARY OF THE INVENTION

The present invention provides a method and apparatus for improving the moisture removal capability of an annular moisture extraction slot immediately upstream of a last rotating blade of a low pressure turbine by applying suction to the slot at low loads. Two alternative suction means are disclosed: (1) a steam ejector or jet pump utilizing motive steam from an upstream location and discharging into spaces between inner and outer walls of the turbine; and (2) a water ejector utilizing condensate pump discharge, first cooled in a heat exchanger to prevent flashing as a motive fluid.

In one form of the invention there is disclosed a water extraction system for a steam turbine which comprises an annular channel circumscribing an inner wall of the turbine adjacent a low pressure blade row. The channel extends through the turbine wall and defines a wall face in one end of the turbine wall facing the channel. The water collection extraction system includes an annular water collection slot formed in a wall face with a plurality of bores which extend through the wall from the collection slot to an outer surface of the wall. A pump is connected to the bores adjacent the outer surface of the wall for suctioning water from the collection slot. In one form the pump comprises an ejector. In another form of the invention, the water collection system includes a manifold with the bores connected to the manifold and the pump connected for suctioning water from the manifold.

BRIEF DESCRIPTION OF THE DRAWINGS

For a better understanding of the present invention, reference may be had to the following detailed description taken in conjunction with the accompanying drawings in which:

FIG. 3 is a simplified partial drawing of a turbine exhaust system illustrating one method for obtaining motive fluid for moisture extraction for the inventive system; and FIG. 4 is a cross-sectional view similar to FIG. 2 incorporating an alternate embodiment of the present invention.

DETAILED DESCRIPTION OF THE DRAWINGS

Figure 1:
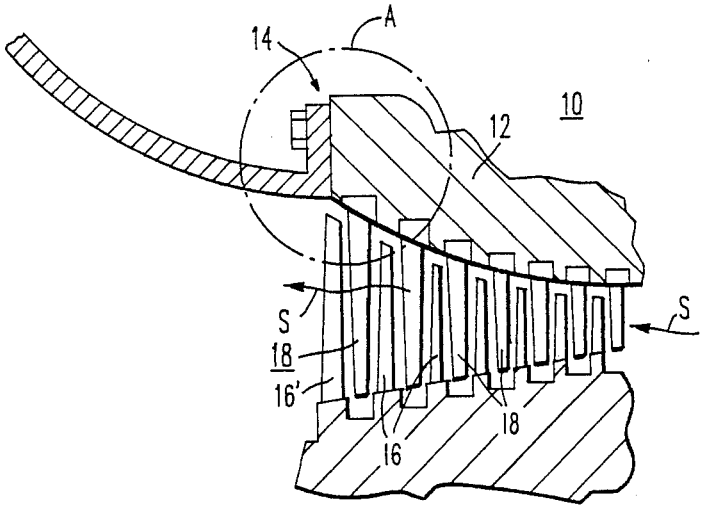
FIG. 1 is a cross-sectional view of a portion of a turbine and inside of its casing showing the relative locations of the annular collection slot in the casing and the last rotating blade.
Figure 2:
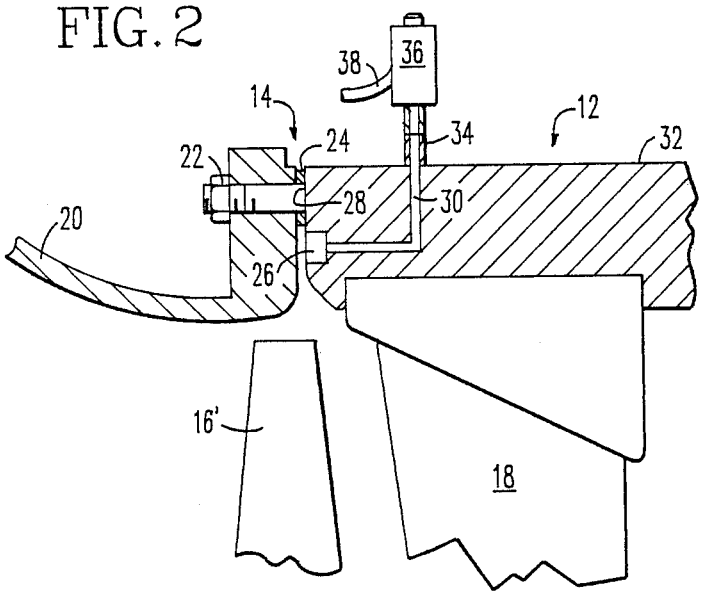
FIG. 2 is a detail view of the encircled portion of FIG. 1 showing incorporation of the present invention.

A typical installation of an annular moisture removal slot 14 in an inner casing 12 of a low pressure steam turbine 10 is shown in FIGS. 1–3. The arrow S indicates direction of steam flow. In the partial cross-sectional view of FIG. 1, water droplets entrained in the flow of steam S are propelled radially by rotating blades 16 of the turbine toward an inner surface of casing 12. Immediately upstream of the last row of rotating blades, indicated at 16', there is formed a circumferential slot 14 communicating with a plurality of spaced apertures passing through inner casing 12. Water droplets drain to a condenser (FIG. 3) by virtue of suction created by the pressure differential existing between the volume inside the turbine and the volume outside the turbine inner casing.

FIG. 2 is an enlarged cross-sectional view of the area encircled by line A in FIG. 1 but incorporating the teaching of the present invention. The slot 14 actually comprises a space between an end of inner shell 12 and a flow guide or diffuser 20. The flow guide 20 is attached to shell 12 by a plurality of bolts 22 circumferentially spaced about the annular guide 20. The slot 14 is maintained by a plurality of spacers or washers 24 positioned on bolts 22 between shell 12 and guide 20. The circumferential spacing between the bolts and associated washers forms the apertures extending through the shell as mentioned above. Typically, the slot 14 may be between about 0.100 and 0.250 inches (0.25 to 0.63 cm). Sizing is generally selected to provide about 0.75 percent of mass flow through slot 14.

As modified in accordance with the present invention, a collection slot 26 is formed in the end face 28 of shell 12 facing the slot 14. The collection slot 26 may be a continuous annular slot or a series of circumferentially spaced slots. Spaced slots may be required to avoid interference with washers 24. The edges of slot 26 are rounded or beveled to minimize opportunity for flashing which may occur due to sudden pressure drops at sharp edges or corners.

A plurality of bores 30 are formed through shell 12 from an outside surface 32 thereof and connecting to each of the slots 26 or at spaced intervals to the continuous slot 26. At the surface 32 each of the bores 30 terminate in a fitting or nipple 34 which provides a convenient connection for piping to an ejector or jet pump 36. The ejector 36 may use as motive fluid high pressure (HP) steam introduced through input pipe 38 or, preferably, subcooled water taken from water leaving the condenser. Use of HP steam may cause a turbine performance loss since such extracted steam would not be available for its normal purpose of driving the rotating blades of the turbine. The ejector 36 is of a type well-known in the art and serves to pump or suction the collected water from collection slot 26. The water may be sprayed into the space between the outer and inner walls of a double wall turbine where it is collected in a standard turbine process and returned to the turbine condenser.

Referring now to FIG. 3, one method and apparatus for obtaining subcooled water for ejector 36 is shown. The turbine exhausted steam passes through exhaust hood 40 and is delivered to condenser 42. Cooling water enters the condenser 42 through piping 44 and is exhausted to a cooling pond or other reservoir. The condensed steam, now water, passes through pump 46 to the turbine feedwater train indicated at 48, eventually being converted to steam and again supplied to the turbine.

In order to obtain subcooled water at sufficient pressure to drive the ejector 36, water is tapped from the output of pump 46 via piping 50 and directed to a small heat exchanger 52. The piping 50 may be coiled within the exchanger 52. Water from cooling water input piping 44 is tapped and conveyed via piping 54 to heat exchanger 52. After circulating about piping 50, the cooling water is returned to piping 44. The subcooled water in piping 50 exiting heat exchanger 52 is conveyed to pipe 38 at ejector 36 where it serves as the motive fluid for extracting water from slot 26.

FIG. 4 is a partial cross-sectional view of an end of a turbine 10 showing a further modification of the present invention in which a manifold 54 has been added to collect water from several bores 30 through nipples 34. This modification reduces the number of pumps 36 by providing a single pump for each manifold.

While the method of extracting water droplets will be apparent from the above description, briefly reiterating it can be seen that water droplets are driven into slot 14 by the rotational motion of the blades 16 and the pressure differential between the inside volume of the turbine and the volume outside the turbine wall 12. A collection slot or series of slots 26 are formed in face 28 of wall 12 for accumulating water droplets entering slot 14 and which are not driven outside wall 12. A plurality of bores 30 are formed through wall 12 connecting to slots 26. Each bore 30 is connected to an ejector 36 which suctions water droplets from slots 26 and expels them outside the turbine wall 12. The ejectors 36 are preferably powered by subcooled water taken downstream of condenser 42.

While the invention has been described in what is presently considered to be a preferred embodiment, other modifications, variations and adaptations will become apparent to the skilled in the art. It is intended therefore that the invention not be limited to the particular embodiment but be interpreted within the spirit and scope of the appended claims.

What is claimed is:

1. A water extraction system for a steam turbine comprising:

an annular channel circumscribing an inner wall of the turbine adjacent a low pressure blade row, said channel extending through the turbine wall and defining a wall face in one end of the turbine wall facing said channel;

an annular water collection slot formed in said wall face;

a plurality of bores extending through said wall from said collection slot to an outer surface of said wall; and pump means connected to said bores adjacent said outer surface of said wall for suctioning water from said collection slot.

2. The system of claim 1 wherein said pump means comprises an ejector.

3. The system of claim 1 and including a manifold, said bores being connected to said manifold and said pump means being connected for suctioning water from said manifold.

4. The system of claim 1 wherein said collection slot comprises a plurality of circumferentially spaced slots, each of said spaced slots being coupled to said pump means by a corresponding one of said bores.

5. The system of claim 1 wherein said annular channel is formed between an end of said turbine wall and an attached steam flow guide, said guide being attached to said turbine by a plurality of bolts, and said annular channel being established by washers on the bolts compressed between said guide and said turbine wall.

6. The system of claim 2 and including pipe means coupled between a high pressure stage of said turbine and said ejector for supplying high pressure steam to said ejector for creating a suction for extracting water from said collection slot.

7. The system of claim 2 wherein said turbine includes a condenser, a source of cooling water for the condenser, and a feedwater pump for returning water from the condenser to a turbine feedwater train, the system further including piping means for tapping a portion of the feedwater from the feedwater pump and coupling the water to the ejector as motive fluid therefor, said piping means including a heat exchanger for receiving condenser cooling water for subcooling the feedwater to the ejector.

8. In a method of draining water from the interior of a steam turbine casing, the method utilizing pressure head within the turbine to effect drainage of the water through an annular channel disposed between inner and outer surfaces of an inner cylindrical casing of a steam turbine, an improvement comprising the following steps:

forming a slot in the turbine wall facing the channel and oriented transversely thereto;

forming a plurality of drain bores between the slot and an outer surface of the turbine wall; and pumping water collected in the slot through the drain bores to outside the turbine wall.

* * * * *